US005389310A

United States Patent [19]

Leiponen

[11] Patent Number: 5,389,310

[45] Date of Patent: Feb. 14, 1995

[54] METHOD AND APPARATUS FOR DISPERSING GAS INTO LIQUID

[75] Inventor: Matti O. Leiponen, Espoo, Finland

[73] Assignee: Outokumpu Mintec OY, Espoo, Finland

[21] Appl. No.: 138,400

[22] Filed: Oct. 15, 1993

[30] Foreign Application Priority Data

Oct. 16, 1992 [FI] Finland ..... 924717

[51] Int. Cl.[6] ..... B01F 3/04

[52] U.S. Cl. ..... 261/87

[58] Field of Search ..... 261/87

[56] References Cited

U.S. PATENT DOCUMENTS

| | | | |
|---|---|---|---|
| 1,383,881 | 7/1921 | Thomas | 261/87 |
| 1,583,591 | 5/1926 | Greenawalt | 261/87 |
| 2,217,231 | 10/1940 | Morse | 261/87 |
| 3,491,880 | 1/1970 | Reck | 261/87 |
| 3,917,763 | 11/1975 | Schafer | 261/87 |
| 4,078,026 | 3/1978 | Fallenius | 261/87 |
| 4,200,597 | 4/1980 | Baum | 261/87 |
| 4,425,232 | 1/1984 | Lawrence | 261/87 |
| 4,611,790 | 9/1986 | Otsuka et al. | 261/87 |
| 4,818,445 | 4/1989 | Onizuka et al. | 261/87 |
| 4,955,586 | 9/1990 | Onizuka et al. | 261/87 |

FOREIGN PATENT DOCUMENTS

| | | | |
|---|---|---|---|
| 1113210 | 8/1961 | Germany | 261/87 |

*Primary Examiner*—Tim Miles
*Attorney, Agent, or Firm*—Smith-Hill and Bedell

[57] ABSTRACT

The invention relates to a method and apparatus for dispersing gas into liquid or slurry, which uses a rotatable rotor at least partly submerged in the liquid, and blades connected thereto. According to the invention, the gas to be dispersed is conducted, via a gas conduit (1, 22, 32) to the inside (7, 27, 37) of the rotor (6) and further to the surrounding liquid or slurry through at least one discharge aperture (12, 28, 38) formed in the rotor blade (8, 26, 36) and being adjustable in width.

17 Claims, 3 Drawing Sheets

Figure 3:
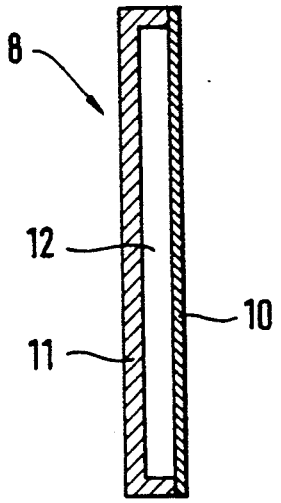

Fig. 1
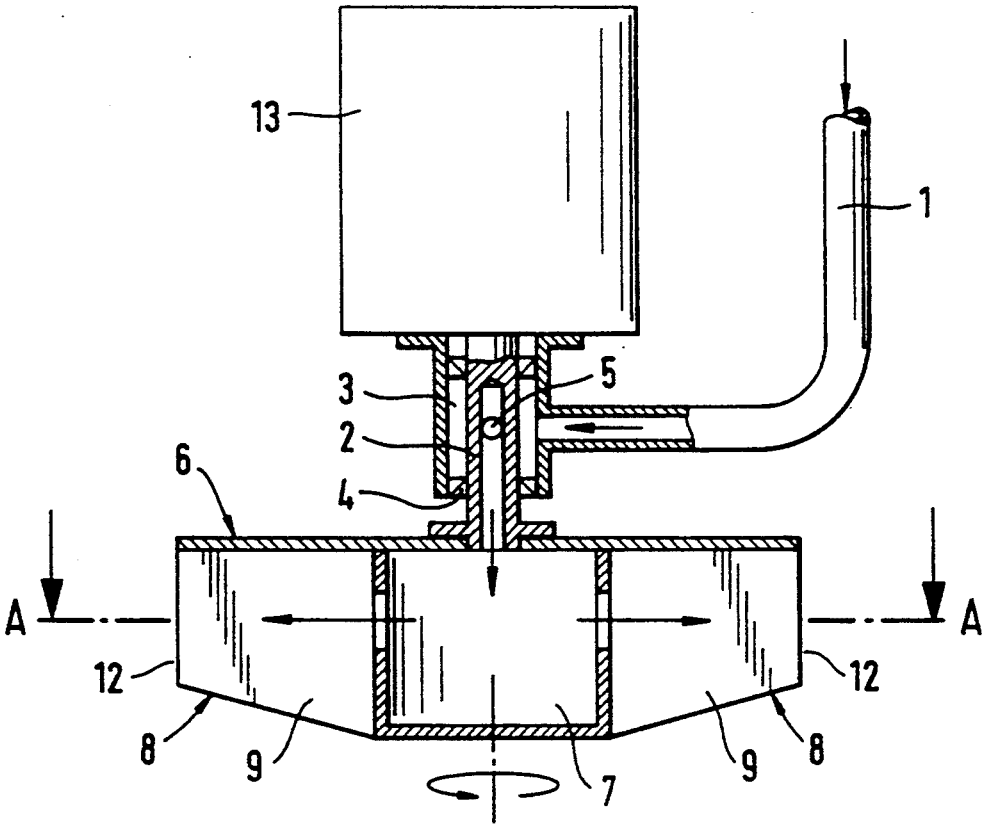
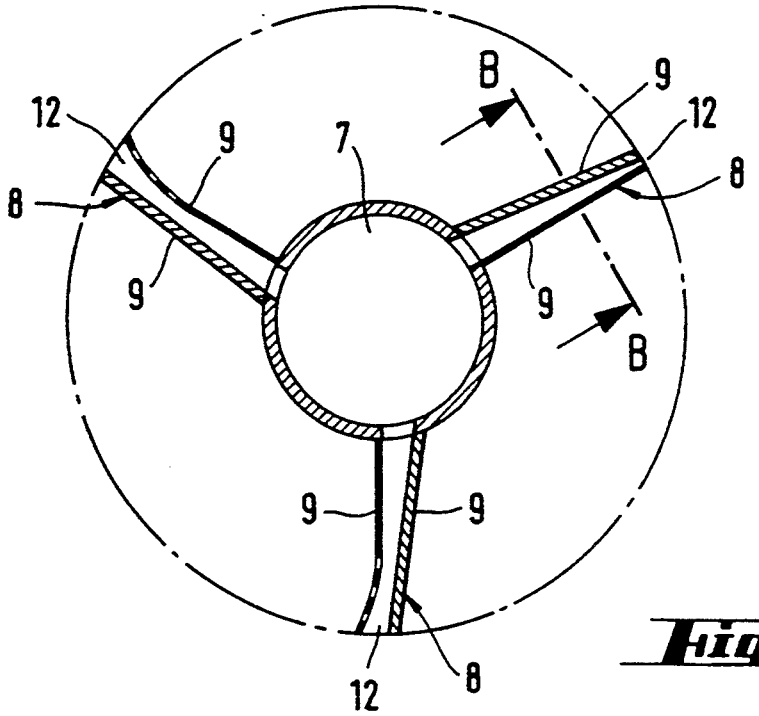
Fig. 2

METHOD AND APPARATUS FOR DISPERSING GAS INTO LIQUID

The present invention relates to a method and apparatus for dispersing gas into liquid, so that the gas used in the dispersion is fed into the liquid through dispersion blades provided in the rotor.

The U.S. Pat. No. 4,078,026 introduces an apparatus for dispersing gas into liquid, and according to one preferred embodiment of the said apparatus, the gas to be dispersed is conducted via the hollow shaft of the rotor and injected through specific gas ducts into liquid slurry. The apparatus of the U.S. Pat. No. 4,078,026 is submerged in the liquid or slurry under treatment, so that at least the stator and rotor of the apparatus are located totally underneath the liquid or slurry surface.

From the U.S. Pat. No. 4,425,232 there is known a rotor-stator pump assembly, where the rotor body includes the hub, blade and top plate members, forming a uniform construction. The gas flow, which is conducted into the gas chamber, is discharged transversally from the gas chamber and flows in gas pockets along the surfaces of the moving blades provided for dispersing the slurry.

In both apparatuses according to the above described U.S. patents, the power consumption of the apparatus depends on the supplied amount of gas, and the power consumption increases essentially when the gas supply is cut off. Moreover, after the cut-off, the particles contained in the surrounding slurry may block the gas injection apertures that are important for the dispersion process. Thus, when restarting the apparatus, the dispersion of gas into liquid becomes essentially more difficult or is nearly stopped altogether.

The object of the present invention is to eliminate some of the drawbacks of the prior art and to create an improved and operationally more secure apparatus for dispersing gas into liquid, in which apparatus the gas discharge apertures are arranged, in order to balance the power consumption of the apparatus, on the dispersion surface of the outer circumference formed by the rotor blades, so that at the beginning of the dispersion treatment, the gas discharge apertures can be cleared of possible particles that might be present therein.

According to the invention, the rotor blades are formed to be box-like, so that the pressure of the liquid inside the rotor blade essentially forces the side walls of the rotor blade apart. Such a liquid pressure is advantageously created while starting the gas supply onto the rotor, so that any liquid that entered the rotor blades and the gas injection pipework during the stoppage, as well as any harmful components possibly contained therein, can advantageously be removed before starting the dispersion treatment proper. Moreover, according to the invention the inner structure of the rotor is advantageously arranged so that the gas to be dispersed can be conducted in a closed space onto the dispersion surface formed by the outer edges of the side walls of the rotor blades, when seen from the rotor axis. Now for instance in the middle part of the rotor there is formed a gas distribution chamber, wherefrom the gas to be dispersed flows into the rotor blades arranged radially with respect to the said chamber. The gas distribution chamber can also be formed inside the rotor, so that above or underneath the rotor blades there is installed a guide member, the inner space thereof being so designed that the gas to be dispersed flows through the guide member either downwardly or upwardly to the rotor blades. Thus the liquid to be aerated during the dispersion treatment comes into contact with the dispersion gas only on the dispersion surface, which is provided with at least one gas discharge aperture per one rotor blade.

The rotor blade of the invention is composed of one or several box-like elements arranged on top of each other in an essentially vertical position, the outer edge whereof, when observed from the rotor axis, forms the dispersion surface of the rotor blade in between the dispersion gas and the liquid to be aerated.

The box-like element used in forming the rotor blade is further composed of at least two parts, so that the element parts form a closed circuit in cross-section. The element parts thus form the walls of the box. The said parts are manufactured so that at least one of the parts is made of a material which is essentially thinner or more elastic than the rest, or weaker in pressure resistance, in which case the liquid pressure created inside the box forces the walls of the box further away from each other.

The parts of the box-like element of the rotor blade of the invention are interconnected so that the cross-section is advantageously either rectangular or wedge-shaped, with the peak upwards or downwards.

When the dispersion apparatus of the invention should be switched off, the rotation of the rotor is stopped and the supply of the dispersion gas is cut off. Now the surrounding liquid can freely flow into the box-like element through the dispersion gas discharge aperture located on the dispersion surface of the rotor blade. In normal process conditions, the surrounding liquid may contain components that are detrimental for dispersion and may block the dispersion gas discharge aperture; therefore it is possible that such particles may enter the rotor blade through the gas discharge aperture located on the dispersion surface of the rotor blade. In the rotor blade of the invention, the discharge apertures are about 1–5 mm wide, in which case also the width of the discharge aperture prevents large harmful components or objects from entering the rotor blade. By composing the rotor blade of the invention of at least two interconnected parts, so that in at least one of these parts the resistance to liquid pressure is poorer than in the rest, the components that are detrimental for the discharge of the gas are expelled from the rotor blade, advantageously at the beginning of the dispersion treatment. The harmful components are advantageously removed from inside the rotor according to the invention, because the parts having different resistance to the pressure of the discharging liquid are forced apart, and the discharge aperture of the dispersion gas is widened from 2–5 times for the duration of the discharge of the liquid pressure; now the detrimental components are advantageously removed from inside the rotor blades prior to the discharge of the dispersion gas proper. When the liquid has flown out of the gas discharge aperture, the drawn-apart wall of the said aperture is returned back to the initial position.

While applying the method and apparatus of the invention, the power required by the apparatus is not essentially increased, when the dispersion gas supply to the apparatus is cut off, for instance due to the specific requirements of the process in question. Accordingly, the rotating and actuating members of the-apparatus cannot be overloaded. Thus the dispersion apparatus of the invention advantageously achieves an improved oxygen transfer efficiency in between the gas to be dispersed and the surrounding liquid, as well as an improved agitation of the liquid on an advantageous power level.

Figure 6:
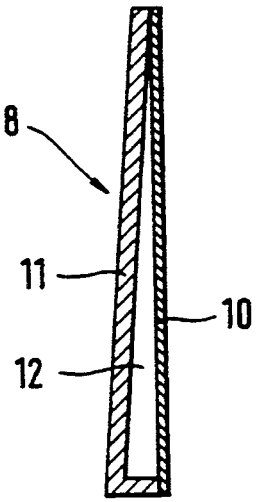
Figure 7:
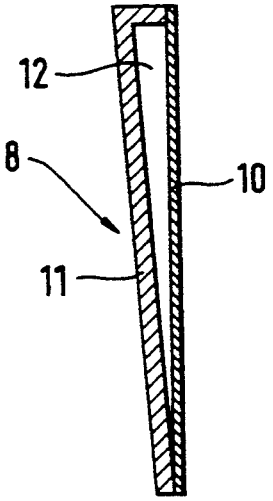
Figure 4:
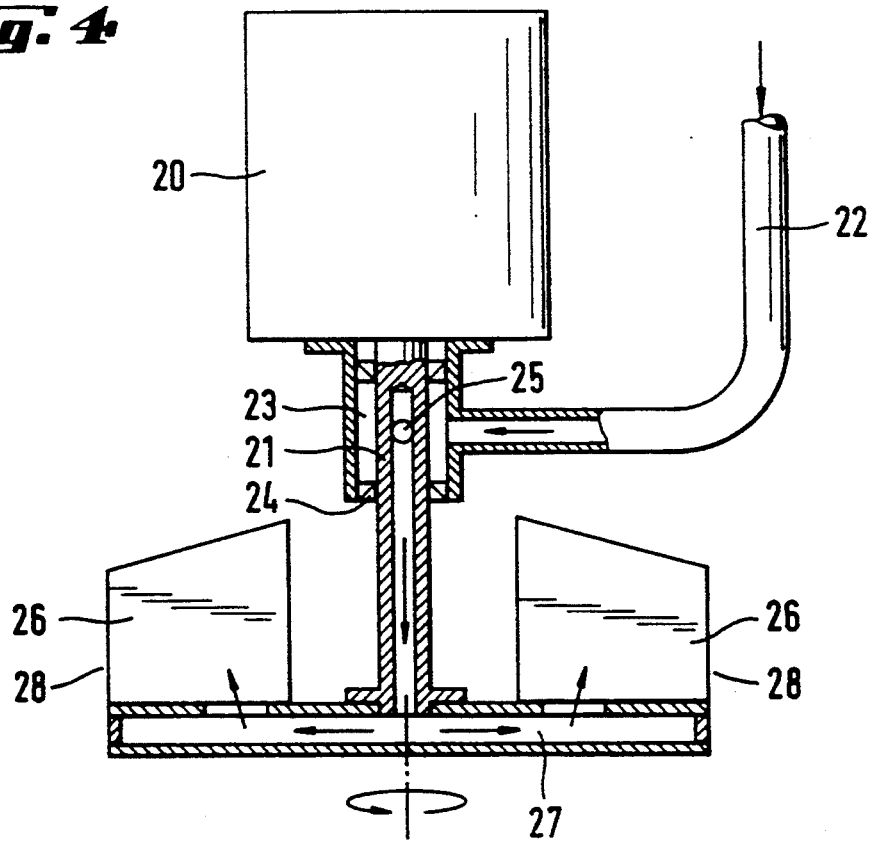
Figure 5:
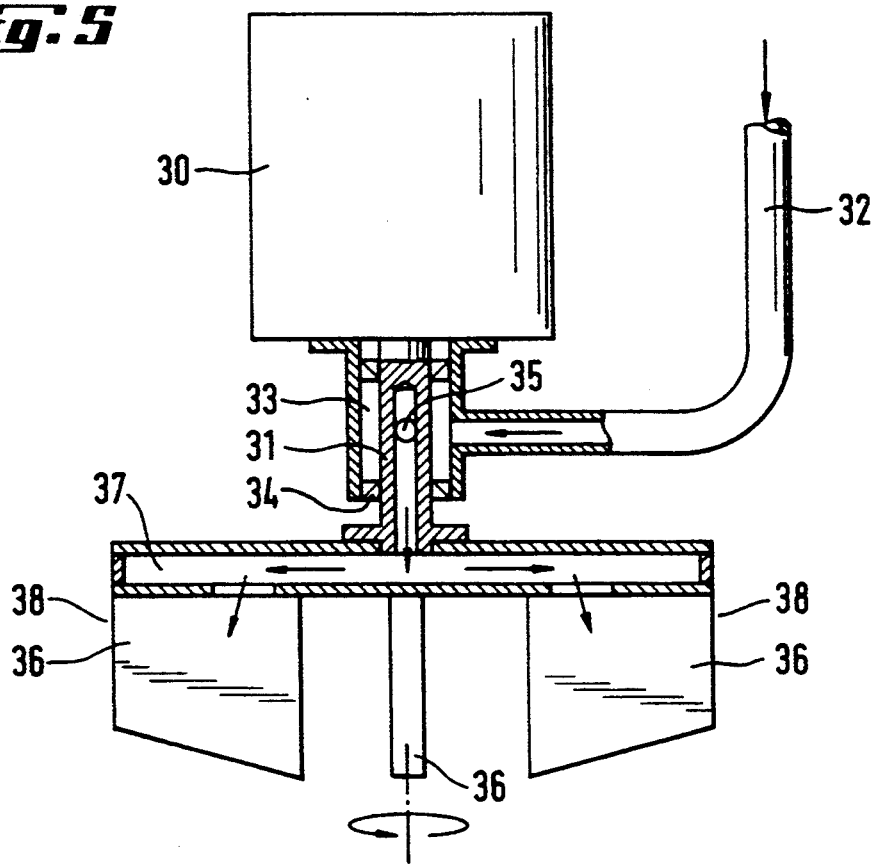

The invention is explained in more detail below, with reference to the appended drawings, where FIG. 1 is a side-view illustration of a preferred embodiment of the invention, FIG. 2 illustrates the section A—A of the embodiment of FIG. 1, FIG. 3 illustrates the section B—B of the embodiment of FIG. 2, FIG. 4 is a side-view illustration of another preferred embodiment of the invention, FIG. 5 is a side-view illustration of a third preferred embodiment of the invention, FIG. 6 illustrates an advantageous modified shape of the gas discharge aperture of the rotor blade of the invention, and FIG. 7 illustrates another advantageous modified shape of the gas discharge aperture of the rotor blade of the invention.

According to FIG. 1, during the dispersion treatment, when the rotor shaft 2 is rotated by means of an actuating assembly 13, the dispersion gas, in this case air, is conducted, via an air conduit 1, to an intermediate space 3 formed around the rotor shaft 2. The intermediate space 3 is sealed around the rotor shaft 2 by means of a sealing 4.

From the intermediate space 3, air is further conducted into the hollow rotor shaft 2 through an inlet 5. From inside the rotor shaft 2, air is discharged into a chamber 7 formed within the rotor 6. From the chamber 7, air is radially discharged into the rotor blades 8, which are made of box-like elements. The box-like element (FIGS. 2 and 3) of the rotor blade 8 is formed so that the essentially vertical side walls 9 of the box gradually converge while proceeding outwards from the rotor axis. The box-like element of the rotor blade 8 is further composed of two parts 10 and 11, forming a closed circuit in cross-section. The part 10 is made of a material somewhat thinner than the part 11, so that the liquid pressure discharged from the rotor blade affects the part 10, and the parts 10 and 11 drawn further apart and the discharge aperture 12 for dispersion gas, located in between the said parts 10 and 11, is widened.

While applying the method of the present invention, the rotor is partly submerged in the dispersable liquid or slurry containing solid particles, so that the air serving as dispersion gas can be injected into the rotor shaft 2 via the air conduit 1 and through the intermediate space 3 from above the liquid surface. In connection with the submersion and at other times, when the air supply is cut off, the solid particles contained in the liquid or slurry to be dispersed are able to flow into the rotor blade 8 via the discharge aperture 12. In that case the blocking of the apparatus also is possible. When the air supply is started, it gives a pressure impact to the dispersable liquid or slurry located inside the rotor. According to the invention, this pressure impact advantageously affects the part 10 of the box-like element of the rotor blade 8, which part 10 is, according to FIG. 3, made of a material thinner than that of the part 11 of the rotor blade. Owing to the pressure impact, the part 10 of the rotor blade advantageously yields, so that the width of the discharge aperture 12 increases and the solid particles possibly flown to inside the rotor blade 8 are advantageously removed back into the surrounding liquid or slurry.

In FIG. 4, during the dispersion treatment, an actuating assembly 20 rotates the rotor shaft 21, and the air serving as the dispersion gas is conducted, via an air conduit 22, to an intermediate space 23 located around the rotor shaft 21, which intermediate space 23 is sealed, with respect to the shaft 21, by means of a sealing 24. From the intermediate space 23, air is conducted, via an inlet 25 to inside the rotor shaft 21. From within the rotor axis 21, air is first discharged to inside a guide member 27 installed underneath the rotor blades 26, and further upwards, to the surrounding liquid through discharge apertures 28 provided on the dispersion surface of the box-like rotor blades 26.

The embodiment of FIG. 5 corresponds to the embodiment of FIG. 4 in that during the dispersion treatment, the actuating assembly 30 rotates the rotor shaft 31, and the air serving as the dispersion gas is conducted via the air conduit 32 to the intermediate space 33 provided around the rotor shaft 31, which intermediate space 33 is sealed, with respect to the axis, with a sealing 34. From the intermediate space 33, air is conducted through the inlet 35 to inside the rotor shaft 31. The difference from the embodiment of FIG. 4 is that from inside the shaft 31, air is first discharged to inside the guide member 37 installed above the rotor blades 36, and further downwards to the surrounding liquid through discharge apertures 38 located on the dispersion surface of the box-like rotor blades 36.

FIGS. 6 and 7 illustrate the shapes of the gas discharge apertures of the rotor blade, so that the aperture 12 of FIG. 6 is wedge-like with the peak upwards, and that of FIG. 7 is wedge-like with the peak downwards.

In addition to the above described embodiments, the invention can naturally be applied in a wider sense within the scope of the appended patent claims.

I claim:

1. A method for dispersing a gas into a non-gaseous flowable medium employing dispersion apparatus comprising a rotor that is at least partly submerged in the flowable medium and has a central axis and an outer periphery, a gas supply conduit for supplying gas to the rotor, and a means for rotating the rotor about the central axis thereof, said method comprising employing a rotor having at least one blade that is hollow and defines an interior space and has at least one discharge aperture that opens radially of the rotor at the outer periphery thereof and is variable in width, and supplying gas under pressure to the interior space of the rotor blade, whereby the gas is discharged into the flowable medium at the periphery of the rotor by way of the variable width discharge aperture.

2. A method according to claim 1, comprising employing a rotor having walls defining a chamber that is connected to the gas supply conduit, the chamber being in communication with the interior space of the rotor blade.

3. A method according to claim 1, comprising employing a rotor that includes walls defining a chamber that is connected to the gas supply conduit and is disposed beneath the rotor blade, the chamber being in communication with the interior space of the rotor blade.

4. A method according to claim 1, comprising employing a rotor that includes walls defining a chamber connected to the gas supply conduit and is disposed above the rotor blade, the chamber being in communication with the interior space of the rotor blade.

5. A method according to claim 1, wherein the width of the discharge aperture is variable in response to difference in pressure between the interior of the rotor blade and the flowable medium outside the rotor blade, and the method comprises developing a pressure difference between the interior of the rotor blade and the flowable medium outside the rotor blade.

6. A method according to claim 1, wherein the width of the discharge aperture is variable in response to pressure of dispersion gas in the interior space of the blade, and the method comprises varying the pressure of dispersion gas in the interior of the rotor blade.

7. A method according to claim 1, wherein the width of the discharge aperture is variable in response to the pressure of liquid in the interior space of the blade, and the method comprises varying the pressure of liquid in the interior space of the blade.

8. Apparatus for dispersing a gas into a non-gaseous flowable medium, comprising a rotor that has a central axis and an outer periphery, the rotor having at least one box-like rotor blade that is hollow and defines an interior space and has at least one discharge aperture that opens radially of the rotor at the outer periphery thereof and is variable in width, a gas supply conduit for supplying gas to the rotor, and a means for rotating the rotor about the central axis thereof.

9. Apparatus according to claim 8, wherein the box-like rotor blade comprises at least first and second parts, said first part being less stiff than said second part.

10. Apparatus according to claim 9, wherein said first part is thinner than the second part.

11. Apparatus according to claim 9, wherein said first part is made of a material that is more elastic than the material of the second part.

12. Apparatus according to claim 9, wherein the first part is made of material that is weaker in stress resistance than the material of the second part.

13. Apparatus according to claim 8, wherein the discharge aperture is substantially rectangular in shape.

14. Apparatus according to claim 8, wherein the discharge aperture is substantially wedge-shaped with the sides of the wedge converging downwards.

15. Apparatus according to claim 8, wherein the discharge aperture is substantially wedge-shaped with the sides of the wedge converging upwards.

16. Apparatus according to claim 8, wherein the rotor comprises a cylindrical support member and said rotor blade comprises a first plate member that extends outwardly from the cylindrical support member and a second plate member that extends outwardly from the cylindrical support member in converging relationship relative to the first plate member, the second plate member being less stiff than the first plate member.

17. Apparatus according to claim 16, wherein the cylindrical support member is tubular and has upper and lower ends, the support member being in communication with the gas supply conduit at one end and being closed at the opposite end, and having a wall formed with an aperture that provides communication between the interior of the support member and the interior space of the rotor blade.

* * * * *